US008821153B2

(12) United States Patent
Van Der Meijden et al.

(10) Patent No.: US 8,821,153 B2
(45) Date of Patent: Sep. 2, 2014

(54) METHOD AND SYSTEM FOR THE PRODUCTION OF A COMBUSTIBLE GAS FROM A FUEL

(75) Inventors: Christiaan Martinus Van Der Meijden, Petten (NL); Lucas Petrus Loduvicus Maria Rabou, Petten (NL)

(73) Assignee: Stichting Energieonderzoek Centrum Nederland, Petten (NL)

( * ) Notice: Subject to any disclaimer, the term of this patent is extended or adjusted under 35 U.S.C. 154(b) by 84 days.

(21) Appl. No.: 13/260,158

(22) PCT Filed: Apr. 14, 2010

(86) PCT No.: PCT/NL2010/050191

§ 371 (c)(1),
(2), (4) Date: Sep. 23, 2011

(87) PCT Pub. No.: WO2010/120171

PCT Pub. Date: Oct. 21, 2010

(65) Prior Publication Data

US 2012/0021364 A1 Jan. 26, 2012

(30) Foreign Application Priority Data

Apr. 16, 2009 (NL) ..... 2002756

(51) Int. Cl.

| | |
|---|---|
| ***F23C 99/00*** | (2006.01) |
| ***C10J 3/52*** | (2006.01) |
| ***C10L 3/08*** | (2006.01) |
| ***C10J 3/00*** | (2006.01) |
| ***C10K 3/02*** | (2006.01) |
| ***C10K 1/08*** | (2006.01) |
| ***C10K 1/04*** | (2006.01) |
| ***C10J 3/84*** | (2006.01) |
| ***C10K 1/00*** | (2006.01) |
| ***C10L 3/10*** | (2006.01) |
| ***C10J 3/48*** | (2006.01) |
| ***C10K 1/14*** | (2006.01) |

(52) U.S. Cl.

CPC ..... *C10L 3/08* (2013.01); *C10J 2300/0916* (2013.01); *C10J 2300/0973* (2013.01); *C10J 3/523* (2013.01); *C10J 2300/0956* (2013.01); *C10J 2300/1838* (2013.01); *C10J 3/00* (2013.01); *C10K 3/02* (2013.01); *C10J 2300/1618* (2013.01); *C10K 1/08* (2013.01); *C10K 1/04* (2013.01); *C10J 3/84* (2013.01); *C10K 1/005* (2013.01); *C10L 3/102* (2013.01); *C10J 3/482* (2013.01); *C10K 1/143* (2013.01); *C10J 2300/1662* (2013.01); *C10L 3/10* (2013.01)

USPC ..... 431/2; 110/229; 110/344; 110/345

(58) Field of Classification Search

USPC ..... 431/2; 110/229, 344, 345

See application file for complete search history.

(56) References Cited

U.S. PATENT DOCUMENTS

| | | | | |
|---|---|---|---|---|
| 4,064,156 | A * | 12/1977 | McRobbie | 518/706 |
| 4,436,532 | A * | 3/1984 | Yamaguchi et al. | 48/209 |
| 4,822,935 | A | 4/1989 | Scott | |
| 2007/0169412 | A1 | 7/2007 | Sinquefield et al. | |

FOREIGN PATENT DOCUMENTS

WO WO-2009/007061 A1 1/2009

OTHER PUBLICATIONS

R.W.R. Zwart, et al., "Production of Synthetic Natural Gas (SNG) from Biomass," Nov. 2006, XP002560825, Retrieved from the Internet: URL: www.ecn.nl/bkm [retrieved on Dec. 14, 2009], p. 49; figure 4.1, p. 50, paragraph 4.1, p. 53, paragraph 4.8.

Search Report in International Application PCT/NL2010/050191 dated Jul. 26, 2010.

* cited by examiner

*Primary Examiner* — Kenneth Rinehart
*Assistant Examiner* — Bao D Nguyen
(74) *Attorney, Agent, or Firm* — Gilberto M. Villacorta; Sunit Talapatra; Foley & Lardner LLP

(57) ABSTRACT

Method and system for the production of a combustible gas from a fuel, comprising the conversion of the fuel, at a temperature that is between 600 and 1000° C. and at a pressure that is lower than 10 bar, into at least a combustible gas that comprises $CH_4$, CO, $H_2$, $CO_2$, $H_2O$ and higher hydrocarbons in a reactor installation (1). At least part of the higher hydrocarbons present in the combustible gas is catalytically converted into at least $CH_4$, CO, $H_2$, $CO_2$ and $H_2O$ in a reactor (45) at a pressure that is lower than 10 bar. After this catalytic conversion, an amount of $H_2O$ and an amount of $CO_2$ are removed from the combustible gas in a separator installation (50) at a pressure that is lower than 10 bar. After the removal of $H_2O$ and $CO_2$, the pressure of the combustible gas is raised by a compressor (71).

17 Claims, 1 Drawing Sheet

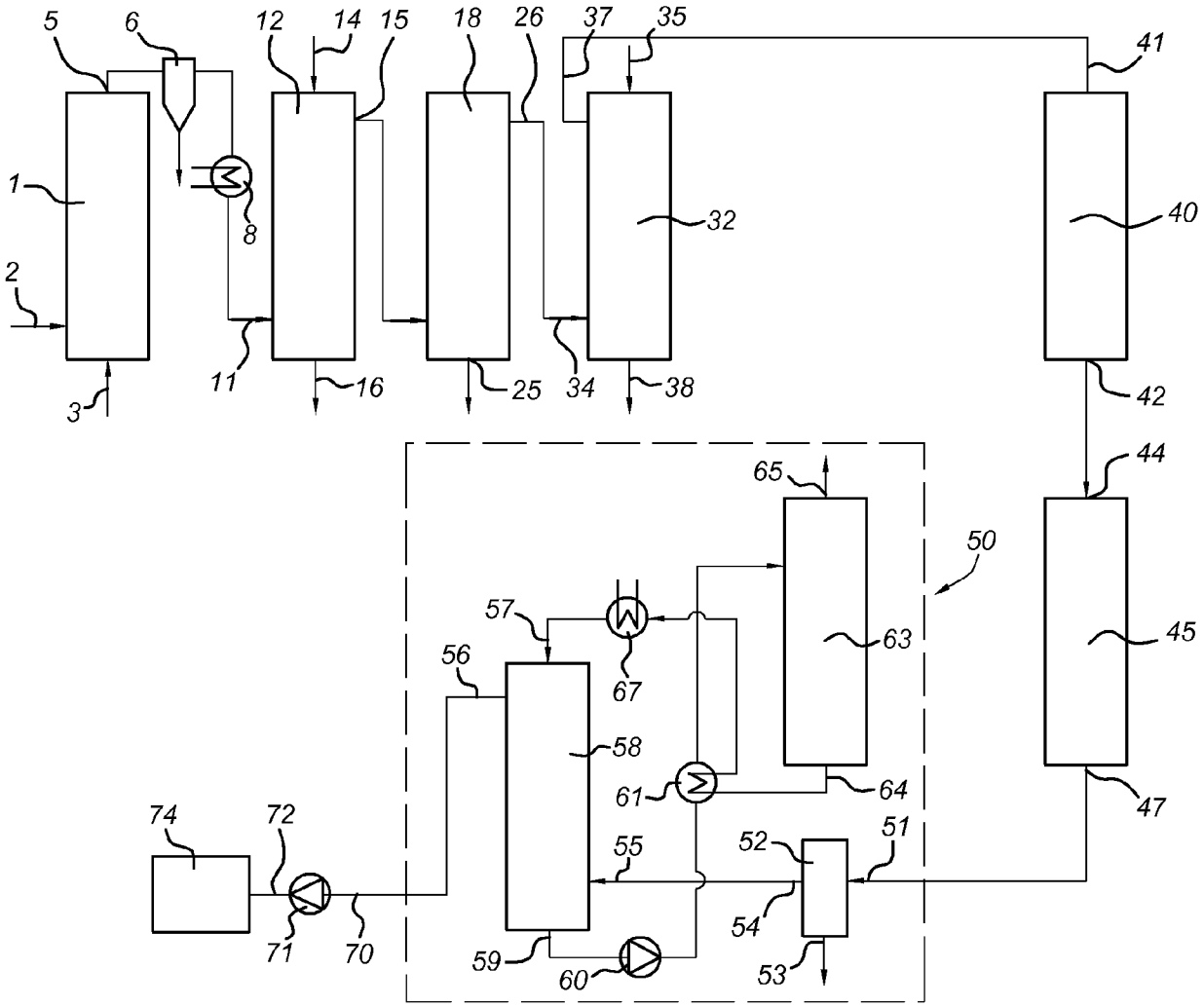
41
40
42
44
45
47
50
63
64
51
65
52
54
53
32
35
38
37
34
26
25
18
15
14
16
12
8
11
6
5
3
1
2
67
61
58
55
60
57
59
56
70
72
71
74

METHOD AND SYSTEM FOR THE PRODUCTION OF A COMBUSTIBLE GAS FROM A FUEL

The present invention relates to a method for the production of a combustible gas from a fuel, comprising:

the conversion of the fuel, at a temperature that is between 600 and 1000° C. and at a pressure that is lower than 10 bar, into at least a combustible gas that comprises $CH_4$, CO, $H_2$, $CO_2$, $H_2O$ and higher hydrocarbons the catalytic conversion of at least part of the higher hydrocarbons present in the combustible gas, at a pressure that is lower than 10 bar, into at least $CH_4$, CO, $H_2$, $CO_2$ and $H_2O$.

The term "gasification" is used in this patent application to denote gasification, pyrolysis or a combination of gasification and pyrolysis. In practice, pyrolysis occurs to some extent simultaneously with gasification.

Gasification and/or pyrolysis of the fuel occur(s) when the latter is heated in a reactor installation to a temperature of 600-1000° C. The introduction of the fuel into the reactor installation is problematic when the latter is operated at a high pressure, especially if the fuel consists of biomass. It is therefore advantageous if the pressure in the reactor installation is relatively low. The combustible gas formed by gasification and/or pyrolysis contains $CH_4$, CO, $H_2$, $CO_2$, $H_2O$ and higher hydrocarbons. For the downstream utilization of the combustible gas, e.g. by burning it in a gas turbine or converting it into synthetic natural gas (SNG), it is necessary to compress the combustible gas. However, this requires a relatively large amount of work for the compression.

WO 2009/007061 discloses a method for converting biomass into synthetic natural gas (SNG). The gasification of the biomass gives a gaseous mixture comprising $CH_4$, CO, $H_2$, $CO_2$ and higher hydrocarbons. This gaseous mixture is brought into contact with a catalyst in a reactor with a fluidized bed to convert it directly into a product gas by methanization and simultaneous water-gas shifting (WGS). To make the product gas suitable for introduction into the natural-gas grid, the product gas is dried, freed of $CO_2$ and compressed to 5-70 bar after methanization.

The article of R. W. W. Zwart et al., entitled "Production of Synthetic Natural Gas (SNG) from Biomass" (ECN Document ECN-E-06-018, November 2006) describes an SNG process, in which the product gas is similarly dried and the $CO_2$ removed only after a separate methanization step in the processing chain.

U.S. Pat. No. 4,822,935 discloses a system for the hydrogasification of biomass. This system does not contain a $CO_2$ removal step, or any indication that such a step should be included in the entire process.

One of the aims of the present invention is to provide an improved method for the production of a combustible gas from a fuel.

This aim is achieved according to the invention by a method for the production of a combustible gas from a fuel, comprising:

the conversion of the fuel, at a temperature that is between 600 and 1000° C. and at a pressure that is lower than 10 bar, into at least a combustible gas that contains $CH_4$, CO, $H_2$, $CO_2$, $H_2O$ and higher hydrocarbons, the catalytic conversion (decomposition) of at least part of the higher hydrocarbons present in the combustible gas, at a pressure that is lower than 10 bar, into at least $CH_4$, CO, $H_2$, $CO_2$ and $H_2O$, after the catalytic conversion, the removal of an amount of $H_2O$ and an amount of $CO_2$ from the combustible gas at a pressure that is lower than 10 bar, after the removal of $H_2O$ and $CO_2$, the raising of the pressure of the combustible gas with the aid of a compressor.

The fuel is converted by gasification and/or pyrolysis in a reactor installation. To carry out the gasification, an amount of oxygen is introduced that is less than the amount needed for burning the fuel. When an insufficient amount of oxygen is used, the fuel is gasified, whereas pyrolysis is conducted in the absence of oxygen. However, gasification and a certain degree of pyrolysis occur at the same time in practice.

The pressure prevailing in the reactor installation is lower than 10 bar and preferably lower than 5 bar, such as 1-2 bar. Owing to this relatively low pressure, the fuel can be fed into the reactor installation in a simple way. The temperature in the reactor installation is between 600 and 1000° C., so that low-temperature gasification takes place in the reactor installation. A combustible gas comprising $CH_4$, CO, $H_2$, $CO_2$, $H_2O$ and higher hydrocarbons is formed in the reactor installation. The combustible gas formed in the reactor installation is a gaseous mixture.

This gaseous mixture comprises incombustible components, such as $CO_2$ and $H_2O$. The combustible components of the gaseous mixture are therefore diluted with these incombustible ones. Owing to the large volume involved, a relatively large amount of energy is needed for raising the pressure of this gaseous mixture. The removal of $CO_2$ and $H_2O$ is rendered problematic by the rather large amount of higher hydrocarbons, like benzene and toluene, present in the gaseous mixture. Furthermore, these hydrocarbons can condense out when compressed, which could be prevented by holding the temperature in the compressor sufficiently high, but this would again be undesirable from the point of view of the amount of compression work needed, and so also from the point of view of the energy consumption of the compressor.

According to the invention, the amount of higher hydrocarbons in the gaseous mixture is first reduced by their catalytic conversion into at least $CH_4$, CO, $H_2$, $CO_2$ and $H_2O$. In other words, the combustible gas is catalytically conditioned according to the invention, so the components that can condense out in the compression step are converted into volatile components.

It should be pointed out that methanization (the formation of $CH_4$ from CO and $CO_2$) may take place here, but—owing to the process conditions involved in the step of catalytic conversion (a relatively low pressure and a relatively high temperature)—methanization will only play a very limited role, and full methanization will definitely not take place.

The catalytic conversion step involved in the process makes the gas suitable for the conventional removal of $CO_2$ and $H_2O$ from the gas at a low pressure. This only produces little or no reduction in the total calorific value of the combustible gas. After the $CO_2$ and $H_2O$ contents of the gas have been reduced, the pressure of the combustible gas is raised by the compressor for downstream utilization. Since the combustible gas in the compressor only contains little or no $CO_2$ and $H_2O$, the compression of the combustible gas is relatively efficient, and the energy consumption of the compressor is reduced.

In one of the embodiments of the invention, when the pressure of the combustible gas has been raised by the compressor, the combustible gas is methanized in order to produce SNG. In this case, the compressor raises the pressure of the combustible gas to 5 bar or more, because such a pressure value is favourable for the methanization of the combustible gas. Compression according to the invention is efficient, since considerable amounts of $CO_2$ and $H_2O$ will have been removed from the combustible gas before methanization. The reason is that this reduces the volume of the combustible gas that is to be compressed.

In another embodiment of the invention, the combustible gas is utilized in a downstream utilization unit after its pressure has been raised by the compressor. The combustible gas brought up to the required pressure is burned for example in a gas turbine, for which a pressure of 20 bar or more is usually required. In this case, too, the amount of energy needed for compression is reduced, owing to the removal of amounts of $CO_2$ and $H_2O$ from the combustible gas.

In one of the embodiments of the invention, the higher hydrocarbons present in the combustible gas comprise unsaturated hydrocarbons, such as $C_2H_2$ and $C_2H_4$, saturated hydrocarbons, such as $C_2H_6$, and aromatic hydrocarbons, such as $C_6H_6$ and $C_7H_8$. In addition, the combustible gas also contains other, higher hydrocarbons, which are formed by gasification in the reactor installation.

It is possible that the conversion of the fuel in the reactor installation into at least a combustible gas is carried out at a pressure that is lower than 5 bar, such as 1-2 bar, in which case the catalytic conversion is conducted at a pressure that is lower than 5 bar, such as 1-2 bar, and the removal of $CO_2$ and $H_2O$ is performed at a pressure that is lower than 5 bar, such as 1-2 bar.

The compressor compresses the combustible gas to a pressure that depends on the downstream utilization of the combustible gas. For example, the compressor raises the pressure of the combustible gas to at least 5 bar and preferably to at least 10 bar, such as 40 bar or more. If the combustible gas is converted into SNG, which is then fed into the national gas grid, then the pressure of the gas obtained after conversion into SNG is increased to the pressure prevailing in the national gas grid, which can be for example 60 bar or more.

In the step in which $CO_2$ and $H_2O$ are removed, at least 70% of the $H_2O$ present in the combustible gas and at least 70% of the $CO_2$ present in the combustible gas can be removed. It is also possible that the combustible gas is essentially free of $CO_2$ and $H_2O$, with less than for example 1% of these compounds remaining in the combustible gas.

In one of the embodiments of the invention, the removal of $H_2O$ from the combustible gas comprises the reduction of the temperature to a value at which $H_2O$ condenses out of the combustible gas, forming a condensate. After the catalytic conversion of the higher hydrocarbons present in the combustible gas, the water can be condensed out by lowering the temperature. The condensed water contains hardly any hydrocarbons, because the combustible components that can condense out when the temperature is reduced will have been catalytically converted.

In one of the embodiments of the invention, the removal of $CO_2$ from the combustible gas comprises the chemical absorption of $CO_2$. For example, the combustible gas is fed into an absorber installation in which the combustible gas is brought into contact with an absorbent for $CO_2$, such as amine. A conventional amine scrubber is suitable for removing the $CO_2$ from the combustible gas in which the higher hydrocarbons have been catalytically converted. The amine scrubber can be operated at a low pressure and a low temperature.

Various catalysts are suitable for the catalytic conversion of at least part of the higher hydrocarbons present in the combustible gas, such as one of which the active component contains at least one of the noble metals Pt, Pd, Rh, Ru, (Os, Ir) and/or at least one of the transition metals Ni, Co, Mo and W. Compounds of these metals, such as NiMoS for example, are also possible.

If the catalyst is not stable to impurities such as tar, sulphur and/or chlorine, it is possible that, prior to the catalytic conversion, an amount of the tar and/or an amount of the sulphur and/or an amount of the chlorine are removed from the combustible gas. However, this step is not necessary when a catalyst is used that is stable to tar, sulphur and/or chlorine.

The method according to the invention is particularly suitable for the production of a combustible gas from biomass. The resulting combustible gas is called "product gas".

The present invention also relates to a system for the production of a combustible gas from a fuel, comprising:

- a reactor installation that is fitted with an inlet opening for the introduction of the fuel, which reactor installation is designed for converting the fuel present in it, at a pressure that is lower than 10 bar, into at least a combustible gas which comprises $CH_4$, CO, $H_2$, $CO_2$, $H_2O$ and higher hydrocarbons, the said reactor installation being also fitted with an outlet opening for the removal of the combustible gas,
- a reactor that is fitted with an inlet opening connected to the outlet opening of the reactor installation, which reactor is charged with a catalyst and is designed for the catalytic conversion of at least part of the higher hydrocarbons present in the combustible gas into at least $CH_4$, CO, $H_2$, $CO_2$ and $H_2O$ at a pressure that is lower than 10 bar, this reactor being also fitted with an outlet opening for the removal of the combustible gas in which at least part of the higher hydrocarbons has been catalytically converted,
- a separator installation that is fitted with an inlet opening connected to the outlet opening of the reactor, which separator installation is designed for the separation of an amount of $H_2O$ and an amount of $CO_2$ from the combustible gas at a pressure that is lower than 10 bar, the said separator installation being also fitted with an outlet opening for the removal of the combustible gas without the $CO_2$ and $H_2O$ which have been separated off,
- a compressor that is fitted with an inlet connected to the outlet opening of the separator installation, which compressor is designed for raising the pressure of the combustible gas, the said compressor being also fitted with an outlet for the removal of the combustible gas at the increased pressure.

The invention will be explained below with the aid of an embodiment which is illustrated in the drawing.

The drawing shows schematically a system for the production of a combustible gas from a fuel, such as biomass.

The drawing shows a reactor installation as item 1. This reactor installation 1 has a first inlet 2 and a second inlet 3, which are schematically indicated by arrows in FIG. 1. The material to be gasified, such as biomass, is introduced into the reactor 1 through the first inlet 2. At the same time, a fluid containing oxygen, for example air, is passed into the reactor installation 1 through the second inlet 3. Steam is also introduced through this second inlet 3. However, the reactor installation 1 can also be fitted with a third inlet (not shown) for the introduction of steam. The amount of air introduced is such that the amount of oxygen present in the reactor installation 1 is less than the amount needed for burning the biomass, i.e. a low-oxygen environment prevails inside the reactor installation 1. The pressure inside the reactor installation 1 is for example 1-2 bar. The biomass is heated in the reactor installation 1 to a temperature of between 600 and 1000° C., for example to a temperature of about 850° C. This ensures the gasification of the biomass, giving rise to a combustible gas. The combustible gas is a gaseous mixture comprising $CH_4$, CO, $H_2$, $CO_2$, $H_2O$ and higher hydrocarbons. This combustible gas is called "product gas".

The water dew point of this combustible gas is for example about 60° C. However, the water dew point can have any value between 50 and 150° C., and in particular between 50 and 100° C. The tar dew point of the combustible gas is considerably higher, such as 120-400° C. The tar dew point of the combustible gas depends on the gasification taking place in the reactor installation 1. The tar dew point of the combustible gas is generally between 300 and 400° C. The hot combustible gas also contains some impurities, such as gaseous tar and dust particles. The dust particles contain solid carbon and ash, called "char".

The reactor installation 1 has an outlet 5. The contaminated combustible gas flows through the outlet 5 and into a first cyclone 6. The cyclone 6 separates out the relatively large solid particles from the combustible gas. These particles contain for example non-gasified biomass and/or sand grains coming from the fluidized bed in the reactor installation 1. The particles separated out are for example returned into the reactor installation 1 (not shown). The cyclone 6, or another installation used to separate out the relatively large particles from the gas, can be an integral part of the reactor installation 1 (not shown). The combustible gas flows from the cyclone 6 into a cooler 8, where the combustible gas is cooled for example to a temperature of 380° C. The combustible gas then flows into an oil-condensing installation 12.

The oil-condensing installation 12 has a first inlet 11 for the combustible gas and a second inlet 14 for the introduction of an oil at a temperature that is lower than that of the combustible gas. The temperature of the oil is higher than the water dew point of the combustible gas, for example about 70° C. As a result, the tar present in the product gas cannot dissolve in the water, which would form a stream of waste product that is difficult to purify. The oil introduced is preferably a tar oil, i.e. a mixture of aromatic compounds. In particular, the tar oil contains the same tars as those forming the impurities in the gas.

The combustible gas and the oil then flow into the oil-condensing installation 12 in counter-current to each other. As the combustible gas flows through the oil-condensing installation 12 in the upward direction, it is wetted by the oil that is sprinkled on it. The product gas is saturated with the oil in the oil-condensing installation 12. Since the relatively cold oil comes into contact with the hot combustible gas, part of the oil is vaporized, forming an oil vapour. The amount of oil vapour decreases as the oil progresses from top to bottom through the oil-condensing installation 12. The temperature here is between the water dew point and the tar dew point of the combustible gas. Due to lack of saturation, this oil vapour condenses on the tar and dust particles present in the combustible gas flowing upward. This gives rise to small droplets, which then grow into larger particles.

The oil-condensing installation 12 has a first outlet 15 for the removal of the oil-saturated combustible gas with the enlarged particles. The temperature of the combustible gas at the outlet opening 15 is reduced to for example 70° C., owing to heat exchange with the oil. The oil-condensing installation 12 also has a second outlet 16 for the removal of liquid oil.

The oil-saturated combustible gas, with the enlarged particles, then flows into a separator installation 18 in order to remove the enlarged particles from the product gas. The separator installation 18 comprises a first outlet 25 for the removal of the separated droplets of tar and/or dust with the condensed oil. The separator installation 18 also has a second outlet 26 for the removal of the combustible gas. This combustible gas is essentially free of dust. The temperature is essentially unchanged, being about 70° C. in this embodiment. The combustible gas is then introduced into an absorber installation 32.

The absorber installation 32 has a first inlet 34, through which the product gas flows into the absorber installation 32, and a second inlet 35 for the introduction of fresh oil. The temperature of this oil is higher than the water dew point of the combustible gas, i.e. the conditions prevailing in the absorber installation 32 are such that no water condenses out. As a result, water and tar cannot form a mixture. However, the temperature of the oil is lower than the tar dew point of the combustible gas. In the present embodiment, the temperature of the oil introduced is about the same as that of the product gas, i.e. about 70° C. The clean oil functions as a wash oil, moving through the absorber installation 32 from top to bottom. The essentially dust-free combustible gas and the oil are in contact with each other in a counter-current arrangement. The gaseous tar compounds present in the combustible gas are therefore absorbed. The rest of the tar is dissolved in the oil.

The absorber installation 32 has a first outlet 37 for the removal of the combustible gas, which is essentially free of dust and tar. The oil contaminated with tar flows out of the absorber installation 32 through a second outlet 38. This second outlet 38 is connected to an oil purification installation (not shown). In this oil purification installation for example air, steam or another fluid is brought into contact with the oil, so that the air picks up tar from the oil. The purified oil is returned to the inlet 35 of the absorber installation 32.

The outlet 37 of the absorber installation 32 is connected to an inlet 41 of an eliminating installation 40 for the removal of sulphur and/or chlorine from the combustible gas. This eliminating installation 40 has an outlet 42 for the removal of the combustible gas from which the sulphur and/or chlorine have been essentially removed. The outlet 42 is connected to the inlet opening 44 of a reactor 45.

The reactor 45 is charged with a catalyst, such as one of which the active component contains at least one of the noble metals Pt, Pd, Rh, Ru, (Os, Ir) and/or at least one of the transition metals Ni, Co, Mo and W. Compounds of these metals, such as for example NiMoS, are also possible. The pressure prevailing in the reactor 45 has approximately the same low value as the pressure in the reactor installation 1, which is 1-2 bar in the present embodiment. However, it is also possible to use a pressure in reactor 45 that has been increased in comparison with the pressure prevailing in the reactor installation 1. For example, this pressure may be increased to about 5 bar. For this purpose, a compressor can be provided between the outlet 37 of the absorber installation 32 and the inlet 41 of the eliminating installation 40.

The higher hydrocarbons present in the combustible gas are catalytically converted (decomposed) in reactor 45 into at least $CH_4$, CO, $H_2$, $CO_2$ and $H_2O$. This happens for example in a reaction with $H_2$, such as:

$$C_2H_2+H_2\rightarrow C_2H_4$$

$$C_2H_4+H_2\rightarrow C_2H_6$$

$$C_2H_6+H_2\rightarrow 2CH_4$$

$$C_6H_6+9H_2\rightarrow 6CH_4$$

$$C_7H_8+10H_2\rightarrow 7CH_4$$

or in a reaction with $H_2O$, such as:

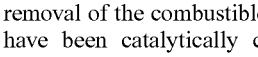

$$C_2H_4+H_2O \rightarrow CO+H_2+CH_4$$

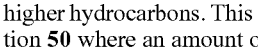

$$C_6H_6+3H_2O \rightarrow 3CO+3CH_4$$

or else in a reaction with $CO_2$, such as:

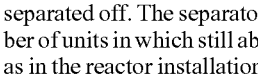

$$C_2H_4+CO_2 \rightarrow 2CO+CH_4$$

In addition to these, other reactions can also take place in reactor 45, such as a very limited conversion of CO and $H_2$ into $CH_4$. However, these reactions are less important than the catalytic degradation described above. This means that virtually no methanization occurs in this step of the process, due to the relatively high temperature. A (virtually complete) conversion of CO, $CO_2$ and $H_2$ into $CH_4$ (methanization) only occurs as the main reaction in the methanization reactors 74 that can be optionally connected up downstream (see below).

Reactor 45 is fitted with an outlet opening 47 for the removal of the combustible gas whose higher hydrocarbons have been catalytically converted. The combustible gas removed through outlet opening 47 is essentially free of higher hydrocarbons. This gas flows into a separator installation 50 where an amount of $H_2O$ and an amount of $CO_2$ are separated off. The separator installation 50 comprises a number of units in which still about the same low pressure prevails as in the reactor installation 1, in the present embodiment 1-2 bar. However, as described above, it is also possible that the pressure here is increased in comparison with that prevailing in the reactor installation 1, for example to about 5 bar.

The separator installation 50 comprises a heat exchanger 52, which is fitted with an inlet opening 51, connected to the outlet opening 47 of the reactor 45. This heat exchanger 52 cools the combustible gas to a temperature at which $H_2O$ condenses out. The condensed water leaves the heat exchanger 52 through an outlet 53. The heat exchanger 52 has an outlet opening 54 for the removal of the combustible gas, which is essentially free of $H_2O$. This outlet opening 54 is connected to a first inlet 55 of an absorber installation 58. This absorber installation 58 also has a second inlet 57 for the introduction of a scrubbing liquid, such as amine. Thanks to the contact between the combustible gas and the scrubbing liquid, $CO_2$ is absorbed by the scrubbing liquid. The scrubbing liquid, with the $CO_2$ taken up by it, leaves the absorber installation 58 through a first outlet opening 59.

The scrubbing liquid, with the $CO_2$ taken up by it, flows from this first outlet 59 into a separator installation 63 through a pump 60 and a heat exchanger 61, and the scrubbing liquid is separated from the $CO_2$ in this separator installation 63. The scrubbing liquid flows through a first outlet 64, the heat exchanger 61 and a second heat exchanger 67, into the second inlet 57 of the absorber installation 58, while the $CO_2$ leaves the separator installation 63 through a second outlet 65. The absorber installation 58 also comprises a second outlet opening 56 for the removal of the combustible gas, without separating off the $H_2O$ and $CO_2$. The removal of $H_2O$ and $CO_2$ from the combustible gas takes place in the separator installation 50 at a relatively low temperature and a relatively low pressure.

The second outlet opening 56 is connected to the inlet 70 of a compressor 71. The combustible gas has a temperature of 10-50° C. at the inlet 70, while its pressure essentially has about the same low value as the pressure in the reactor installation 1, in the present embodiment 1-2 bar. As described above, however, it is also possible to have a pressure here that is increased with respect to that in the reactor installation 1, for example to about 5 bar. The compressor 71 raises the pressure of the combustible gas to more than 5 bar, for example to 20-80 bar. Since the combustible gas is hardly diluted with $CO_2$ and $H_2O$ or not at all, the energy consumption of the compressor 71 is relatively low. The combustible gas at the increased pressure leaves the compressor 71 through an outlet 72. This outlet 72 is connected to a downstream utilization unit 74.

The downstream utilization unit 74 is used for example for methanization, i.e. the production of methane ($CH_4$) by the reaction:

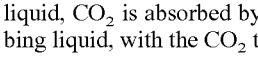

$$CO+3H_2 \rightarrow CH_4+H_2O \quad (1)$$

or by the reaction:

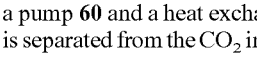

$$CO_2+4H_2 \rightarrow CH_4+2H_2O \quad (2).$$

A catalyst with Ni as its active component is generally used to promote these reactions. This catalyst also promotes the water-gas shift reaction:

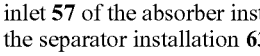

$$CO+H_2O \rightarrow CO_2+H_2 \quad (3).$$

The above reactions can also proceed in the opposite direction. Thus, reaction (2) is the sum of reaction (1) and the reverse reaction (3). The sum of reaction (1) and reaction (2) gives:

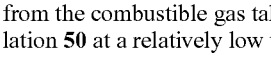

$$2CO+2H_2 \rightarrow CH_4+CO_2$$

The ratio between the various components of the gas will determine which of these reactions will actually take place. In the case of methanization as the downstream utilization, it is advantageous if the pressure is raised by the compressor 71 to at least 5 bar and preferably to at least 10 bar.

However, the downstream utilization unit 74 can also be for example a gas turbine, in which the combustible gas is burned at its raised pressure. If the combustible gas is used in a gas turbine, the compressor 71 generally raises its pressure to 20 bar or more.

The invention is not restricted to the embodiment illustrated in the FIGURE. Those skilled in the art will be able to devise various modifications which lie within the scope of the invention.

The invention claimed is:

1. A method for the production of a combustible gas from a fuel, comprising, sequentially:

(a) converting the fuel, at a temperature that is between 600 and 1000° C. and at a pressure that is lower than 10 bar, into at least a combustible gas that comprises $CH_4$, CO, $H_2$, $CO_2$, $H_2O$ and higher hydrocarbons, the higher hydrocarbons comprising at least aromatic hydrocarbons, (b) catalytically converting at least part of the higher hydrocarbons, including the aromatic hydrocarbons, at a pressure that is lower than 10 bar, into at least $CH_4$, CO, $H_2$, $CO_2$ and $H_2O$, (c) removing an amount of $H_2O$ and an amount of $CO_2$ from the combustible gas at a pressure that is lower than 10 bar, (d) raising of the pressure of the combustible gas with a compressor, and (e) methanizing the combustible gas of (d) without use of steam.

2. The method according to claim 1, further comprising (e) burning the combustible gas of (d).

3. The method according to claim 2, wherein the combustible gas of (d) is burned in a gas turbine.

4. The method according to claim 1, wherein the higher hydrocarbons comprise unsaturated hydrocarbons, saturated hydrocarbons, or aromatic hydrocarbons.

5. The method according to claim 4, wherein the unsaturated hydrocarbons comprise $C_2H_2$ and $C_2H_4$, the saturated hydrocarbons comprise $C_2H_6$, and the aromatic hydrocarbons comprise $C_6H_6$ and $C_7H_8$.

6. The method according to claim 1, wherein any of steps (a)-(c) is carried out at a pressure that is lower than 5 bar.

7. The method according to claim 6, wherein any of steps (a)-(c) is carried out at a pressure between 1-2 bar.

8. The method according to claim 1, wherein the pressure of the combustible gas is raised to at least 5 bar.

9. The method according to claim 8, wherein the pressure of the combustible gas is raised to at least 10 bar.

10. The method according to claim 1, wherein at least 70% of the $H_2O$ and at least 70% of the $CO_2$ in the combustible gas are removed.

11. The method according to claim 1, wherein the removal of $H_2O$ comprises cooling the combustible gas to a temperature at which the $H_2O$ present in the combustible gas condenses and forms a condensate.

12. The method according to claim 1, wherein the removal of $CO_2$ comprises chemical absorption of $CO_2$.

13. The method according to claim 12, wherein the combustible gas is introduced into an absorber installation, in which the combustible gas is brought into contact with an absorbent for $CO_2$.

14. The method according to claim 13, in which the absorbent is an amine.

15. The method according to claim 14, wherein the catalytic conversion is carried out with a catalyst comprising an active component comprising at least one of the noble metals Pt, Pd, Rh, Ru, (Os, Ir) or at least one of the transition metals Ni, Co, Mo and W, or compounds thereof.

16. The method according to claim 1, wherein a quantity of tar, sulphur or chlorine are removed from the combustible gas prior to step (b).

17. The method according to claim 1, wherein the fuel comprises biomass.

* * * * *